United States Patent [19]

Howorth

[11] 4,009,647

[45] Mar. 1, 1977

[54] CLEAN AIR ZONE FOR SURGICAL PURPOSES

[75] Inventor: Frederick Hugh Howorth, Chorley, England

[73] Assignee: Howorth Air Engineering Limited, Bolton, England

[22] Filed: Apr. 16, 1975

[21] Appl. No.: 568,614

[30] Foreign Application Priority Data

Apr. 26, 1974 United Kingdom ..... 18303/74

[52] U.S. Cl. ..... 98/36; 98/40 D; 128/1 R; 55/DIG. 29

[51] Int. Cl.[2] ..... F24F 9/00

[58] Field of Search ..... 98/36, 40 D; 128/1 R; 55/DIG. 29

[56] References Cited

UNITED STATES PATENTS

| | | | |
|---|---|---|---|
| 3,151,929 | 10/1964 | Potapenko | 55/DIG. 29 |
| 3,367,257 | 2/1968 | Raider et al. | 98/40 D |
| 3,380,369 | 4/1968 | Allander | 98/36 |
| 3,626,837 | 12/1971 | Pelosi, Jr. | 98/36 |
| 3,631,788 | 1/1972 | Lankfeldt | 98/40 D |
| 3,726,204 | 4/1973 | Lindestrom | 98/36 |
| 3,776,121 | 12/1973 | Truhan | 98/36 |
| 3,803,995 | 4/1974 | Allander | 98/36 |
| 3,824,909 | 7/1974 | Horneff et al. | 98/40 D |
| R25,216 | 8/1962 | Kennedy | 98/40 D |

*Primary Examiner*—John J. Camby
*Assistant Examiner*—Henry C. Yuen
*Attorney, Agent, or Firm*—Ross, Ross & Flavin

[57] ABSTRACT

Apparatus for providing a clean air zone around a patient undergoing surgery in the form of a plurality of air delivery means and air supply means for supplying sterile air to the air delivery means, a first central one of the air delivery means being adapted to supply air at a first velocity and a second outer one of the air supply means being adapted to supply air at a second lower velocity.

2 Claims, 6 Drawing Figures

CLEAN AIR ZONE FOR SURGICAL PURPOSES

This invention relates to a clean air zone formed around the patient undergoing surgery to minimise the possibility of the access of bacteria to the wound(s).

It is known to create such a zone by supplying sterile air from roof mounted diffusers over an area about ten feet square. Such a zone has to have the flowing air enclosed in either side walls, for example solid walls of glass or plastics material, or a curtain of high velocity air. The solid walls have the disadvantage of reducing accessibility in certain operations and the high speed air curtain has the disadvantage that if the curtain of air is broken contaminants pass to the low velocity air of the zone. Further, the curtain of high velocity air has the unfortunate effect of creating turbulence and tending to entrain material from the floor of the operating theatre and mix them into the sterile area.

An object of the present invention is to provide apparatus for producing a clean air zone around a patient in which the disadvantages of the known zones are obviated or minimised.

Accordingly the invention provides apparatus, for providing a clean air zone around a patient undergoing surgery, comprising a plurality of air delivery means and air supply means for supplying sterile air to the delivery means, a central first one of the delivery means being adapted to supply air at a first velocity and a second outer one of the supply means being adapted to supply air at a second lower velocity.

Conveniently the delivery means can be constituted by diffusers, for example fabric diffuser tubes or ceiling panels having perforations therein or being of textile materials.

In one preferred embodiment there are three delivery means, each in the form of a rigid perforated panel. The central panel is supplied with air at a first velocity (e.g. 110 ft/min linear), and is about two feet square. The next adjacent panel is two feet wide and surrounds the central panel. Air is supplied to the second panel at a second lower velocity (say 75 ft/min linear). The third delivery means is in the form of a third panel again about two feet wide and surrounding the second panel. Air is supplied to and delivered by the third panel at a third, still lower, velocity (say 40 ft/min linear).

In a second embodiment such diffuser is in the form of a hollow tube of textile material about 10 feet long and 15 inches in diameter. Six such diffusers are arranged in parallel disposition to cover an area of ceiling about 10 feet square. At the ends of the tubes vertical walls, for example of glass or plastics material, extend from ceiling to floor.

A central two of the tubes constitute the first central delivery means and air is supplied to them and delivered by them at a first velocity (e.g. 110 ft/min linear). The next two outer tubes constitute second air delivery means and air is supplied to them and delivered to them at a second lower velocity, (say 75 ft/min linear). The two outermost tubes constitute the third air delivery means and air is supplied to them and delivered to them at a third, still lower, velocity (say 40 ft/min linear).

The second embodiment for a two-way graded flow arrangement could also be equally accomplished with rigid perforated ceiling panels.

The supply means of this embodiment could, of course, be constituted by perforated ceiling panels.

The invention will be described further, by way of example, with reference to the accompanying drawings, it being understood that the following description is illustrative and not limitative of the scope of the invention. In the drawings.

Figure 1:
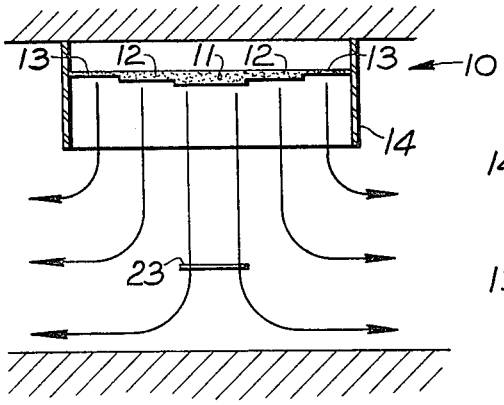
FIG. 1 is a cross-sectional elevation through a preferred embodiment of apparatus conforming to the invention.
Figure 2:
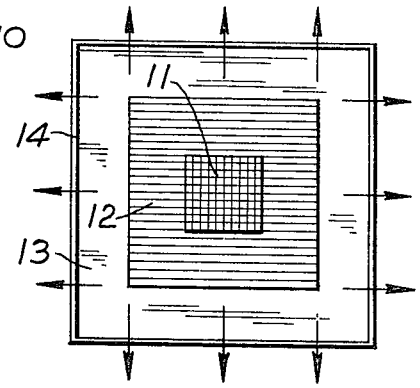
FIG. 2 is an inverted plan view of the apparatus of FIG. 1.

A first preferred embodiment of apparatus 10 conforming to the invention comprises three air delivery means. The first is a fist panel 11, of perforate rigid material or of textile material, about two feet square; the second is a second panel 12 of similar material about two feet wide and surrounding the first panel 11; and the third is a third panel 13 of similar material, about two feet wide and surrounding the second panel 12. The air delivery means 11, 12, 13 occupy a ceiling area of about 10 feet square and are surrounded by a canopy 14. Air supply means (not shown) can be in the form of a fan and air purifier(s). There may also be humidifier(s), heater(s), and/or cooler(s), and ducting (not shown) serves to supply conditioned air to the delivery means 11, 12, 13 independently or as a whole. This latter can be the case where the panels are perforate, in which case the central panel will have larger perforations than the middle part 12 and the middle panel 12 will have larger perforations than the outer panel 13.

The panels 11, 12, 13 and/or air supply means are preferably so constructed that the first panel 11 supplies air at about a linear velocity of from 90–130 feet per minute, preferably 110 feet per minute and the second panel at a linear velocity of 60–90 feet per minute (preferably 75 feet per minute) and the third panel at a linear velocity of 20–60 feet per minute (preferably 40 feet per minute). It must be noted, however, that whilst the velocities of the flows from the delivery means can vary there must always exist a differential between adjacent flows of, at least 5 feet per minute and preferably 10 feet per second.

The flow gradient is preferably exponential.

Figure 3:
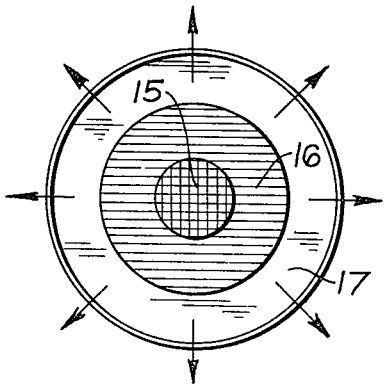
FIG. 3 is an inverted plan view of a modified apparatus similar to that of the first embodiment.

As a variation (FIG. 3) delivery means can comprise a circular central panel 15 and annular second and third panels 16 and 17. A cylindrical canopy 18 can surround the panels.

This first embodiment of apparatus provides a rapid downwardly, and later outwardly, flow of air (as shown by the arrows) adjacent a wound and progressively slower flows away from the wound. Thus any contaminant, or contaminated object approaching the would does so against a rapidly increasing velocity. Access by theatre staff is possible to the patient from all sides.

Figure 4:
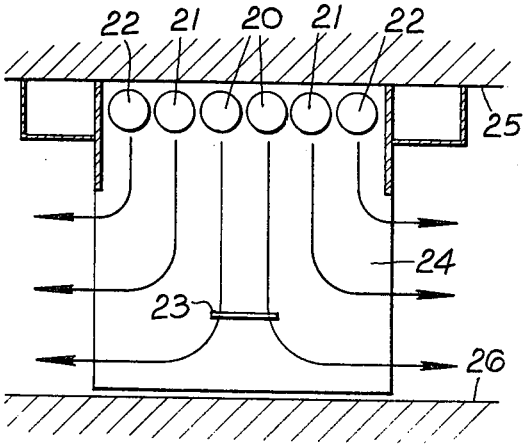
FIG. 4 is a cross-sectional elevation through a second preferred embodiment of apparatus conforming to the invention.
Figure 5:
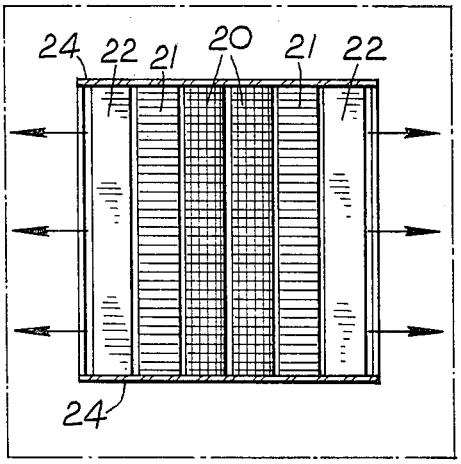
FIg. 5 is an inverted plan view of the apparatus of FIG. 4.
Figure 6:
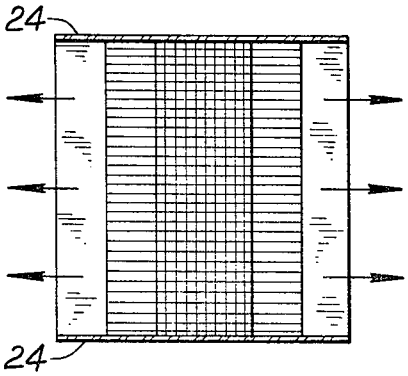
FIG. 6 is an inverted plan view of a modified apparatus similar to that of the second embodiment.

A second preferred embodiment of apparatus 19 (FIG. 4) conforming to the invention is suitable for use when all-around access is unnecessary and access from two opposite sides of a patient is satisfactory. This embodiment has six 10 feet long diffuser tubes 20, 21,

22 of textile material, each about 15 inches in diameter. The tubes are disposed adjacent a ceiling of an operating theatre above an operating table indicated by numeral 23 and at their ends transparent walls 24 extend from the ceiling 25 to close to the floor 26. The gap between the lower ends of the walls 24 and the floor 26 allows air reaching the floor to pass out beneath the walls 24 rather than contact them and perhaps move upwardly entraining material from the floor.

The diffuser tubes are spaced apart so that they occupy an area about ten feet square. The central two diffuser tubes 20 constitute first delivery means and have conditioned air supplied thereto (as in the first embodiment) and deliver air at a velocity the same as that of the panel 11 in the first embodiment. The pair of diffuser tubes 21 adjacent the central pair 20 constitute second air delivery means and have conditioned air supplied thereto, and deliver it, at the same velocity as the panels 12 of the first embodiment. The outer tubes 22 constitute third air delivery means, have conditioned air supplied thereto and delivery it, at the same velocity as the panels 13 of the first embodiment. The comments in relation to the velocities in relation to the first embodiment apply equally well to the velocities in the second embodiment.

The apparatus of each embodiment operates in the same way in that air flow is always stronger nearest the patient or the wound. Any airborne matter approaching the patient meets an increasing air flow and thus the wound is substantially protected from such airborne matter. The apparatus of the invention has the advantage over other known apparatus that enclosing walls all round the operating area are unnecessary and access by the operating theatre staff is unimpaired. This is particularly important in deep surgery, where a large team can be involved and wherein the deep wounds are most susceptible to infection and the patient is so much weaker and less able to fight infection.

In either embodiment if panels are used they can be of transparent material and the usual theatre lamp(s) disposed thereabove. The heat of the lamp(s) is thus dissipated and conducted away by the air. To aid this the panels can be made of or include a heat absorbing material.

In either embodiment the air supply means need not be ceiling mounted to supply air vertically downwards. It can be mounted to supply air horizontally (for example from a wall, or at any other angle to the patient).

The invention includes an operating theatre provided with the above described apparatus.

I claim:

1. Apparatus for providing a clean air zone around a patient undergoing surgery comprising:

a plurality of air delivery means, a plurality of air supply means for supplying sterile air to the air delivery means, a first central one of the air delivery means being adapted to supply air at a first velocity, and a second outer one of the air supply means being adapted to supply air at a second velocity lower than the first velocity, the different air delivery means having different permeabilities for attaining the desired flow velocity differential.

2. Apparatus for providing a zone of sterile air around a patient undergoing surgery comprising:

first and second and third adjacent air delivery means, each air delivery means being in the form of a rigid perforated panel having different permeabilities, a plurality of air supply means for supplying sterile air to the respective air delivery means, the first air delivery means being provided air at a first velocity, the second air delivery means being provided air at a second velocity lower than the first velocity, the third air delivery means being provided air at a third velocity lower than the second velocity.

* * * * *